US006961958B1

(12) United States Patent
Seitzinger

(10) Patent No.: US 6,961,958 B1
(45) Date of Patent: Nov. 8, 2005

(54) CONCEALABLE BALLISTIC PROTECTIVE PANTS WITH TAIL BONE COVERAGE

(76) Inventor: Kyle Seitzinger, 2104 Castle Beach Ct., League City, TX (US) 77573

( * ) Notice: Subject to any disclaimer, the term of this patent is extended or adjusted under 35 U.S.C. 154(b) by 58 days.

(21) Appl. No.: 10/950,885

(22) Filed: Sep. 27, 2004

(51) Int. Cl.[7] ..... F41H 1/02
(52) U.S. Cl. ..... 2/2.5
(58) Field of Search ..... 2/2.5, 102, 465, 2/466; 428/911; 89/36.05

(56) References Cited

U.S. PATENT DOCUMENTS

| | | | | | |
|---|---|---|---|---|---|
| 2,790,973 | A | * | 5/1957 | Lewis, Jr. et al. | 2/2.5 |
| 3,331,083 | A | | 7/1967 | Holly | 2/2.5 |
| 3,771,171 | A | | 11/1973 | Mitchell | 2/2.5 |
| 3,829,899 | A | | 8/1974 | Davis | 2/2.5 |
| 4,316,286 | A | | 2/1982 | Klein | 2/2.5 |
| 4,475,247 | A | | 10/1984 | Lee | 2/2.5 |
| 4,884,295 | A | * | 12/1989 | Cox | 2/467 |
| 5,044,011 | A | * | 9/1991 | Henderson | 2/2.5 |
| 5,327,811 | A | * | 7/1994 | Price et al. | 89/36.05 |
| 5,373,582 | A | | 12/1994 | Dragone | 2/2.5 |
| 5,443,882 | A | | 8/1995 | Park | 428/103 |
| 5,443,883 | A | | 8/1995 | Park | 428/103 |
| 5,471,906 | A | | 12/1995 | Bachner | 89/36.05 |
| 5,572,737 | A | | 11/1996 | Valice | 2/465 |
| 5,754,982 | A | * | 5/1998 | Gainer | 2/2.5 |
| 5,829,653 | A | | 11/1998 | Kaiser | 224/577 |
| 5,926,856 | A | | 7/1999 | Duval | 2/455 |
| 5,970,513 | A | | 10/1999 | Kocher | 2/2.5 |
| 5,974,585 | A | * | 11/1999 | Bachner, Jr. | 2/2.5 |
| 5,996,115 | A | | 12/1999 | Mazelsky | 2/2.5 |
| 6,026,510 | A | | 2/2000 | Kocher | 2/2.5 |
| 6,182,288 | B1 | * | 2/2001 | Kibbee | 2/2.5 |
| 6,453,791 | B1 | * | 9/2002 | Seitzinger | 89/36.05 |
| 6,543,055 | B2 | * | 4/2003 | Howland et al. | 2/2.5 |

* cited by examiner

*Primary Examiner*—Danny Worrell
(74) *Attorney, Agent, or Firm*—Buskop Law Group, P.C.; Wendy Buskop

(57) ABSTRACT

A device for stopping a bullet having undergarment pants, pockets attached into the undergarment pants or a one piece under garment, covering each femoral artery path, at least one pocket sewn into the undergarment pants covering the lower portion of the spine of the wearer, and at least three removable ballistic protection pads one each to be inserted into each pocket and thereby cover each femoral artery and iliac vessels path and the lower portion of the spine of a wearer.

30 Claims, 11 Drawing Sheets

CONCEALABLE BALLISTIC PROTECTIVE PANTS WITH TAIL BONE COVERAGE

FIELD

The present embodiments relate generally to bullet resistant clothing to be worn beneath conventional clothing to protect the arteries of the femur simultaneously with the tailbone of the wearer.

BACKGROUND

Gun shot wounds to the femur arteries of the human body cause death in most cases. Body armor has existed for many years, but undergarment body armor for the lower portion of the body, particularly the arteries of the femur along with the tailbone of the user has not existed.

The major National Institute of Justice Threat Levels of conventional body armor are "Over-clothing Body Armor" or externally worn body armor, as typically seen in the movies for swat team shots, hereinafter referred to as OBA, and concealable body armor normally worn under a shirt, hereinafter referred to as UBA.

Over-clothing body armor is generally bulky, heavy, and sometimes very conspicuous when worn. The military and law enforcement versions of OBA include flack jackets or body armor. For civilian clothing use, versions of OBA have been made to look like cold weather coats or jackets to provide less conspicuous protection when required. However, cold weather coats worn during warm weather are not inconspicuous. The business suit jacket is a more versatile, less conspicuous configuration of OBA, but this configuration lacks frontal below the belt protection, which is considered by many to be a most vital area.

Existing concealable body armor typically weighs 4 pounds to 10 pounds, creates body heat build up, and restricts the movement of the user due to the UBA material's inflexibility. Another major disadvantage of UBA is its difficulty to put on and take off since it is worn under other clothing. Additionally, there is only one form of UBA which is available for use "below the belt and it is a cumbersome apron like device which is difficult to move in and adjust.

The numerous disadvantages of conventional UBA result in the reluctance of an individual to wear the equipment unless the user feels substantially threatened. This results in the user taking risks of not wearing body armor when it is warranted.

Vascular injuries to the lower abdomen and lower extremities carry a high mortality rate. In a study at Ben Taub Hospital, of Houston, Tex., between 1999 and 2000, of 600 patients with penetrating trauma to the iliac vessels and femoral arteries, 39% died within 30 days of injury. In certain cases of penetrating trauma to the iliac vessels, cardiac arrest occurred within 6 minutes to 8 minutes of impact.

A need has existed for an under clothing body garment which provides protection over the femur arteries, the femoral arteries path, as well as the tailbone which is light, and breathable so that a user will actually wear it during duty.

The present embodiments meet these needs.

BRIEF DESCRIPTION OF THE DRAWINGS

The detailed description will be better understood in conjunction with the accompanying drawings as follows.

The present embodiments are detailed below with reference to the listed Figures.

DETAILED DESCRIPTION OF THE PREFERRED EMBODIMENTS

Before explaining the present embodiments in detail, it is to be understood that the embodiments are not limited to the particular embodiments and that it can be practiced or carried out in various ways.

The present body armor embodiments were designed to provide an undergarment to help these soldiers and law enforcement officers prevent injuries to the femoral arteries and iliac vessels that often cause death.

Helicopter pilots fighting the war in Iraq are particularly susceptible to bullets from the ground which penetrate the metal plates of the helicopter and injure the pilot and the crew in the legs and the buttocks. This invention prevents harm to the pilots by providing ballistic material protection to the lower spine and buttocks as well as the iliac vessels and femoral arteries.

The concept was developed to provide protection to the thighs, lower abdomen and hamstring area of the leg. The undergarment can be made of a sturdy, breathable material, similar to athletic undergarments. In another embodiment, the undergarment material can made of stab resistant material, which makes the device particularly good for soldiers having hand to hand combat with knives, or for correctional use in the jail system.

The body armor of the present invention provides the simultaneous protection of the spine and tailbone which prevents paralysis of the wearer caused by a bullet and death due to penetration of the femoral arteries by a bullet.

The present body armor embodiment provides a spinal protection zone that has the benefit of being more form fitting providing ease of mobility for an officer. The body armor of the invention is sleek, and fits and close to the body.

By fitting concealably under the clothes, the armor can be worn comfortably under a law enforcement uniform, armed forces uniforms, tight fitting jeans, a tuxedo, a suit, or any other clothing used by an officer or soldier.

The protection to the spine, iliac vessels and femoral arteries should save law enforcement officers lives. Currently, when an officer is shot in a femoral artery, the officer will only survive from about 4 minutes to about 6 minutes without medical treatment. Unfortunately, even if the medical treatment personnel reach the law enforcement officer in time, the medical personnel are often forced to stay at a distance in a shooting situation until the area is secured by law enforcement. In the meantime, the officer dies. The invention was designed to prevent these losses due to these injuries.

Figure 1:
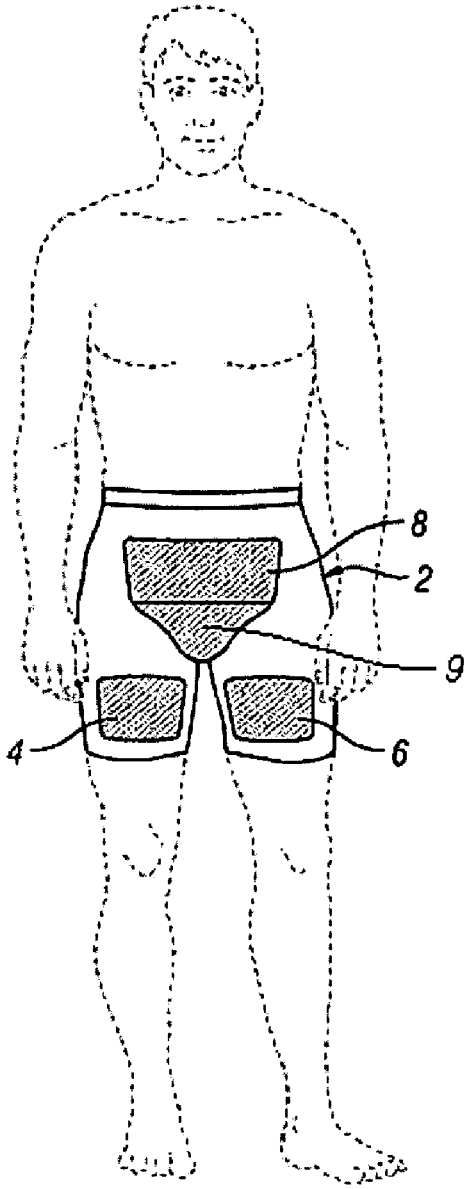
FIG. 1 depicts a front perspective view of a pair of elastic tight fitting shorts with femoral artery protection, iliac vessels protection and tailbone protection.

With respect to the figures, FIG. 1 depicts undergarment body armor having undergarment pants 2, two or more leg pockets 4 and 6, wherein the leg pocket are fastened to the pants covering each femoral artery path.

One or more front pockets 8 can be fastened to the undergarment pants covering the lower portion of the abdomen. One or more removable ballistic protection pads can be inserted into each pocket and thereby cover each femoral artery and iliac vessels path.

The pockets can be closeable pockets. The closeable pockets can be attached so that the ballistic protection pad(s) do not move from the place desired to be protected. An additional front pocket 9 can be situated on the pants to cover the genital area of the body.

Preferably, National Institute of Justice Threat Level IIa armor is used in the pockets of in the pants as packets of ballistic material. The National Institute of Justice Threat Level IIa armor is very flexible and can easily be placed in the pockets.

In a preferred embodiment, the pockets into which the packets are placed are sewn onto the pants in such a manner as to conform exactly to the shape of the packet. With this construction, during a tactical maneuver, the ballistic protection pad does not come out of the pocket or move away from the critical area, since it is contained securely but removably in the pocket.

Figure 2:
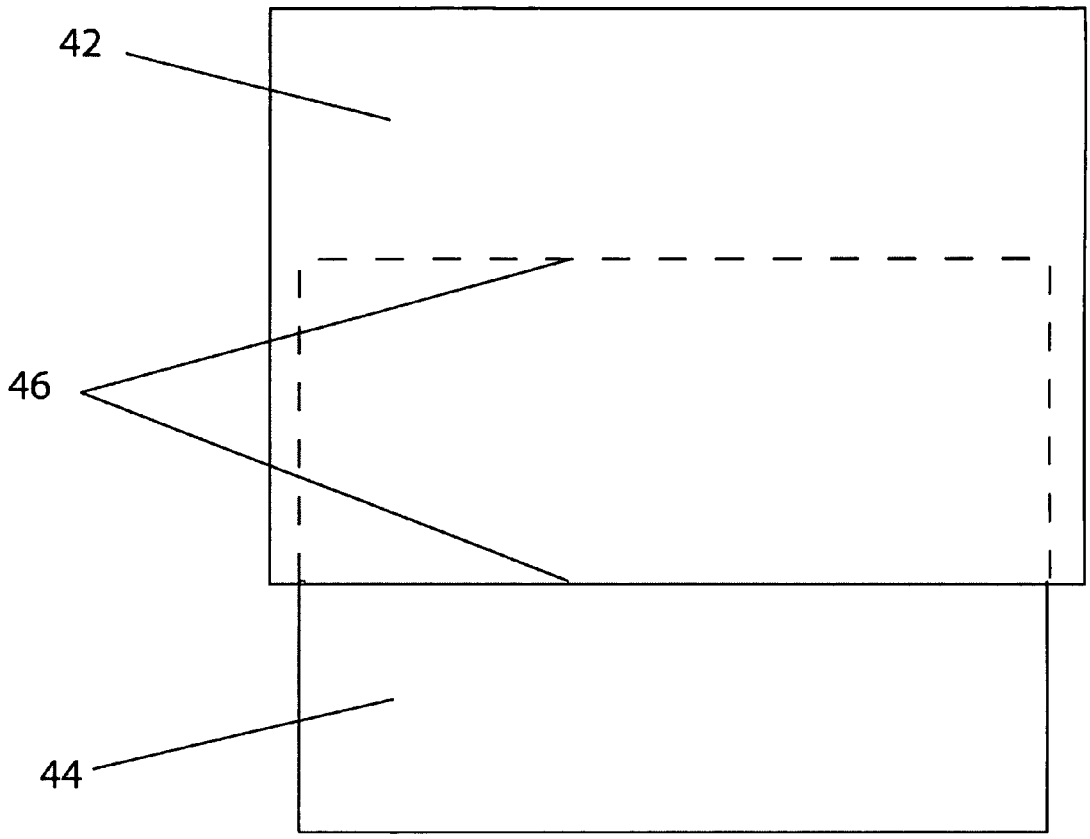
FIG. 2 depicts an embodiment of a pocket for holding the ballistic material usable in this invention.

FIG. 2 depicts a pocket that is made of two pieces of overlapping material where the first piece of material 44 is beneath the second piece of material 42, forming a closeable pocket without the need for a fastener. The overlapping material forms an opening 46 which allows the packet of ballistic material to be inserted through the opening 46 into the pocket and reside behind the flap formed from the first piece of material 44.

Figure 3:
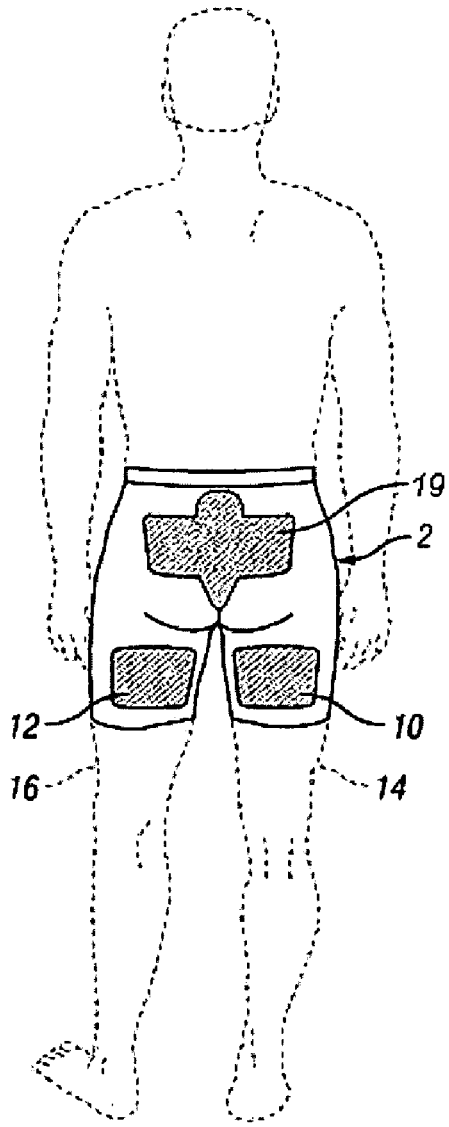
FIG. 3 depicts a rear perspective view of a pair of elastic tight fitting shorts with femoral artery protection, iliac vessels protection and tailbone protection in a T-configuration.

FIG. 3 depicts undergarment body armor having undergarment pants 2, two or more back leg pockets 10 and 12 securely attached to the undergarment pants. The back leg pockets can be configured to cover at least the hamstring of each leg. In this preferred embodiment, one or more back pockets 18 are configured in a T-shape and fastened into the undergarment pants covering the lower portion of the spine of the wearer. It is contemplated that the back leg shapes could be ellipsoid shape, rectangular shaped, or a parallelogram in shape for maximum protection.

Removable ballistic protection pads are configured to be inserted into each pocket of the leg. In this embodiment, the pockets can be closed with fasteners such as hook and loop fasteners such as Velcro™, zippers, elastic closures, snaps, buttons or a combination of these fasteners.

It is possible that the removable ballistic protection pads are permanently adhered to the pockets after insertion with adhesive or another glue that provides a flexible fit.

A T-shaped spinal protector pocket 19 can be added to the pants which provides protection and ease of movement.

Another embodiment of the spinal protector pocket can be a rectangular pocket or an elliptical pocket. The most preferred shape of the spinal protector pocket is a pocket that has a width which is greater than the length. An example of this size pocket would be one that is 6 inches wide and 3 inches high.

Another shape for the spinal protector pocket would be a cross shape or a T-shape which not only provides spinal protection but provides additional protection to the wearer by extending higher on the back. A cross-shaped pocket with ballistic protection pad would be advantageous by providing protection that meets the protection of a vest or upper body ballistic protection for the spine.

In an embodiment, the undergarment body armor can be shorts made of an elastic material, such as nylon, or a blend of nylon and cotton. It is contemplated that biker shorts would be a good material, and lightweight for the pants. Biking shorts which are used for racing bikers is particularly usable herein. In one embodiment, the undergarment body armor could weigh very little, such as six pounds or less, while covering the human pelvis area, the femurs, iliac vessels, the femoral arteries path and the lower spine.

Figure 4:
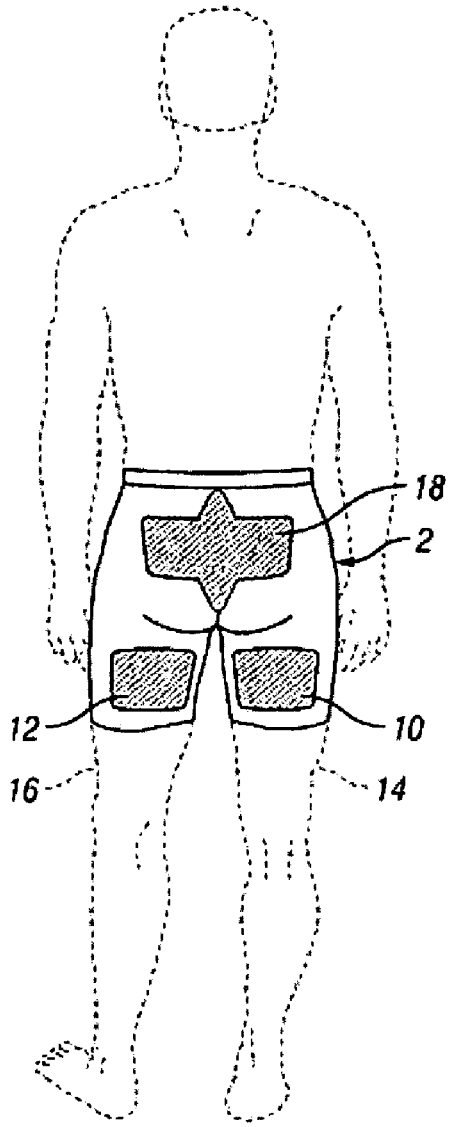
FIG. 4 depicts a rear perspective view of a pair of elastic tight fitting shorts with femoral artery protection, iliac vessel protection and tailbone protection in a cross-configuration.

FIG. 4 depicts undergarment body armor having undergarment pants 2, two or more closable pockets 10 and 12 sewn into the undergarment pants covering the hamstring area of each leg.

One ore more closable pockets 18 can be configured in a cross shape and attached, such as by sewing, onto the undergarment pants covering the lower portion of the spine of the wearer. In this embodiment of the invention, the pocket 18 could be glued to the pants.

Figure 7:
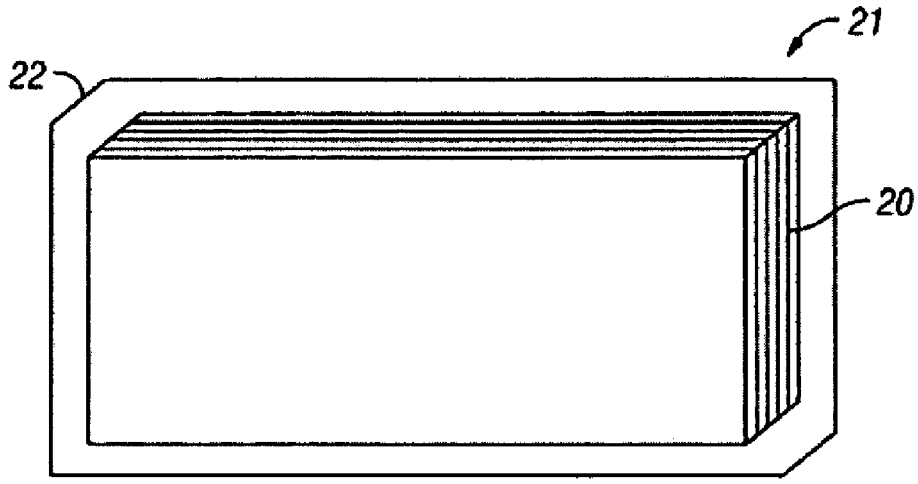
FIG. 7 depicts a cross sectional view of a ballistic protection pad usable in the pockets of the pants.

Removable ballistic protection pads are configured to be inserted into each closable pocket, 10, 12, and 18. The configuration shown in FIG. 4 of the body armor can additionally have pockets on the front side containing ballistic protection pads FIG. 7 depicts a cross sectional view of the multilayer ballistic protection packet 21. In FIG. 7 there is a ballistic material 20, inside a ballistic nylon water resistant, tear resistant, covering 22. This ballistic packet 21 is shown with a rectangular shape. Other shapes can be used as well. Squares, circles, and dog bone shapes of ballistic protection packets can be used for femoral arteries path protection and the lower spine and the hamstring. Various shapes can be used for the packets, which are inserted over the pelvic area of the body. These shapes can be the same shape as the femur area or a different shape. The key is selecting a shape that has comfort, yet affords coverage.

Figure 8:
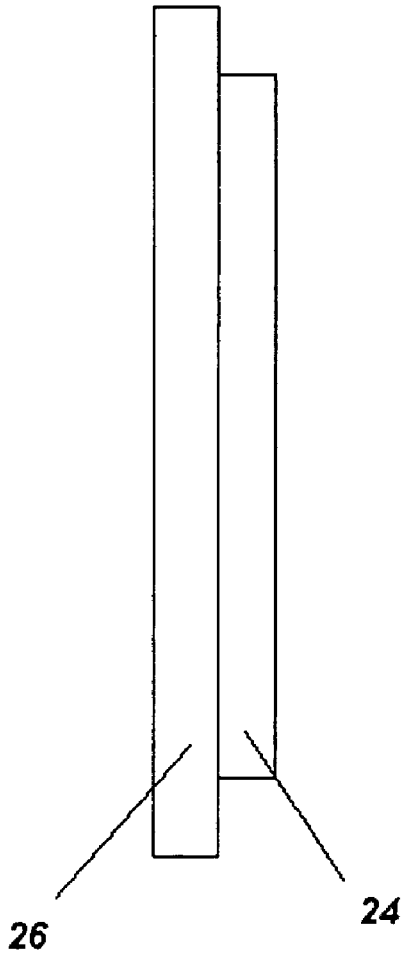
FIG. 8 depicts the hard plate that can be used in front of the ballistic protection pad usable in the pants.

FIG. 8 depicts a cross sectional view of the configuration of a hard plate that can be used in the pockets of the undergarment body armor. The hard plate 24 is placed in front of a piece of ballistic material, on the outermost side of the pocket. The advantage of placing the hard plate in front of the ballistic material is that when a bullet contacts the hard plate the plate shatters taking away the energy of the bullet, and the ballistic material collects the fragments of the hard plate. A major portion of the kinetic energy of the bullet is absorbed by the tile plate, and the residual energy is absorbed by the ballistic pad. The hard plate can be made of a metal or a ceramic. The ceramic plate can be a material such as boron carbide, aluminum oxide or fiberglass laminate.

Figure 9:
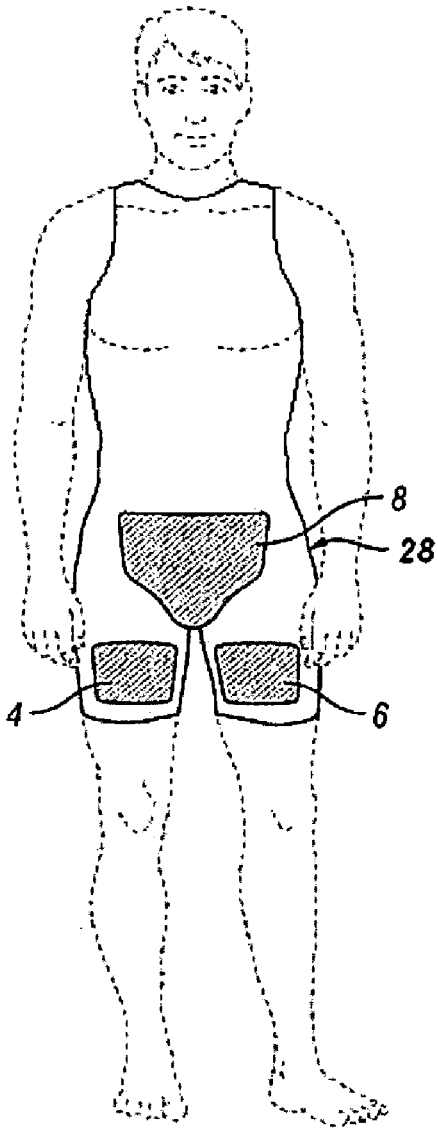
FIG. 9 depicts a front perspective of a one piece undergarment with femoral artery protection, iliac vessel protection, and genital protection.

FIG. 9 depicts a one piece undergarment body armor for a wearer having one piece suit 28 with at least two leg pockets 4 and 6 attached to the one piece suit with each leg pocket covering each femoral artery path. At least one front pocket 8 is fastened to the undergarment pants covering the lower portion of the abdomen of the wearer. One ore more removable ballistic protection pads can be configured to be inserted into each closable pocket to simultaneously cover each iliac vessel and femoral artery path and the lower portion of the abdomen.

The one piece undergarment can be similar to a wrestling suit.

An alternative embodiment entails a one-piece suit with short sleeves, so that the officer does not become overheated and can had adequate ventilation while gaining the protection of the body armor.

The one-piece suit can include a zipper, a button, a hook and loop opening for ease of entry. The suit may be a turtle neck suit similar to a neoprene wet suit, such as a 1 mm to about 3 mm wet suit. The one piece suit can be worn under the clothes of the law enforcement officer. The one piece suit can be worn by a military diver as well.

Figure 10:
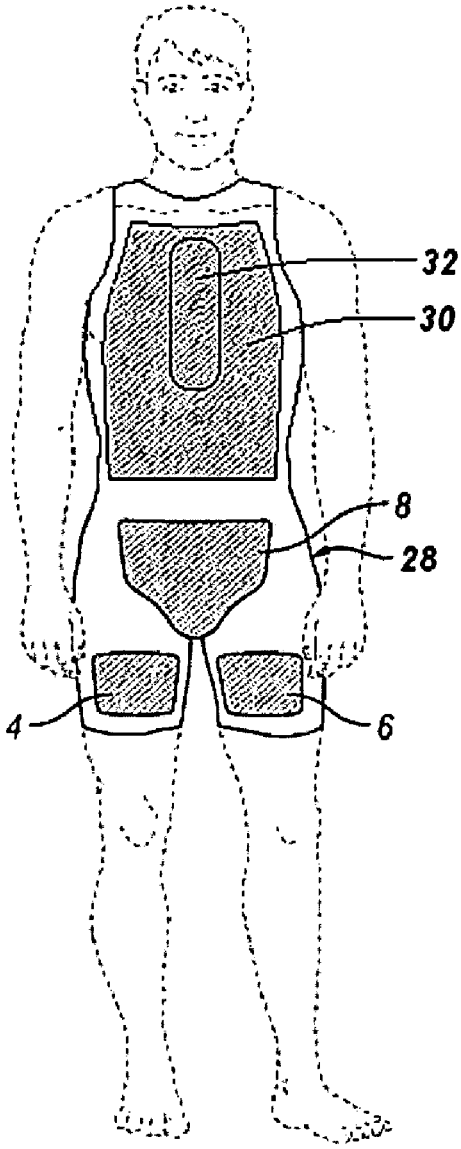
FIG. 10 depicts a front perspective of a one piece undergarment with femoral artery protection, iliac vessel protection, upper body protection, genital protection, and sternum protection.

In addition to the parts in FIG. 9, FIG. 10 depicts a one piece undergarment body suit 28 with an additional upper body pocket 30 which can hold a sternum protection pad 32 made of the ballistic protection material or a plate, which can be ceramic or metal, like the boron carbide plate mentioned above.

The hard plate usable herein can optionally be a plate encapsulated in a polyurethane.

Figure 11:
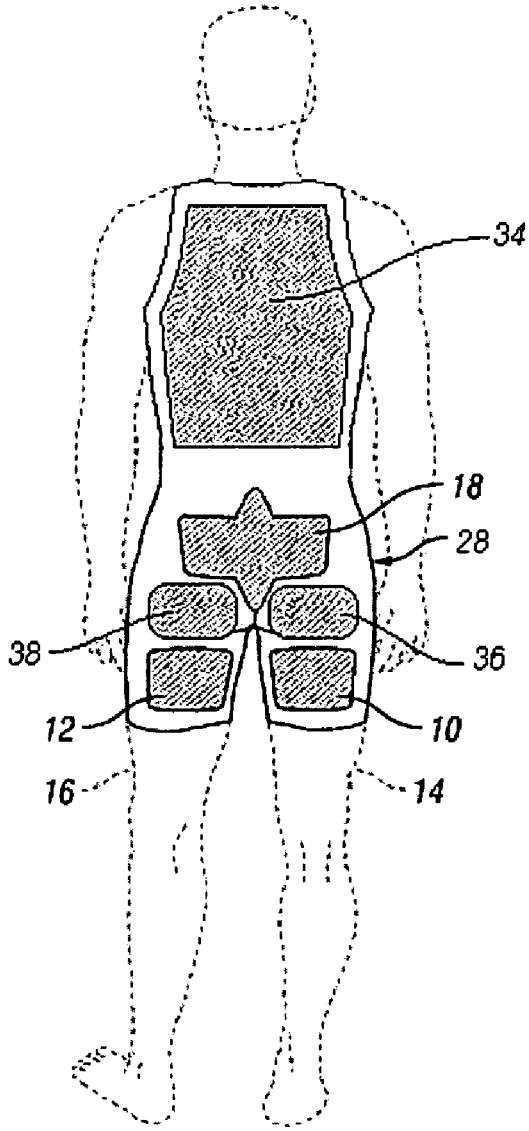
FIG. 11 depicts a rear perspective of a one piece undergarment with hamstring protection, buttocks protection, upper back protection and tailbone protection.

FIG. 11 depicts the back of a one piece undergarment body armor for a wearer which is a suit 28 with a back protection pocket 34 to cover the back of the wearer. A pocket 18 can be in the shape of a "T" to protect the spine. The suit 28 can have buttocks pockets 36 and 38. Additionally hamstring protection is used in this embodiment, as pockets 10 and 12. The one piece body armor can have ballistic protection pads in the pockets described.

Most preferably, National Institute of Justice grade levels II and IIIa utilizing eighteen layers of a ballistic material and a thin metal plate, such as titanium are contemplated from one or more of the pockets described. Grade II can be used which uses fifteen layers of ballistic material and is capable of stopping a bullet fired by a 357 Magnum at a velocity of 1,395 feet per second. The same grade level stops a 9 mm bullet fired at a velocity of 1,175 feet per second. The embodied body armors can be used with a Grade IIa ballistic protection having thirteen layers that can stop a 9 mm bullet traveling at a velocity of 1,090 feet per second. Threat Level III protection stops a 7.63 NATO round of bullets traveling at a velocity of 2,750 feet per second. These various levels are contemplated to be used as the ballistic protection pads of the invention.

The described body armor is contemplated to be custom sized for persons with unusual shapes or lengths of arms, or they can be child-sized protective undergarment such as for a child of a celebrity.

The undergarment body armor and the one piece undergarment body armor can have a pocket fastened into the undergarment pants over the sides of the hips of the wearer. The hip pockets can be closeable.

The undergarment pant can be made of an elastic material such as a material used in the shorts worn by bicycler. The elastic material can be made of nylon and lycra or nylon and cotton and in an embodiment the material would be 80% nylon and 20% lycra or 80% nylon and 20% cotton. It is preferred that the elastic is adapted to wick moisture away from the wearer for at least 8 hours.

Tests were performed on the unique elastic undergarment. The undergarment was placed on a hanger in a range at 7 yards from the shooter.

FIRST TEST—A Smith and Wesson 38-caliber gun was used with a 38-caliber hollow point bullet. The bullet was fired at the embodied body armor using a 17-layer ballistic protection pad and the bullet bounced off of the embodied body armor.

SECOND TEST—A Smith and Wesson 40 caliber Semi-Automatic gun was used with a Smith and Wesson 40 caliber hollow point. The bullet was fired at 7 yards from the test object and with 17 layers of ballistic material in the ballistic protection packets, the bullet bounced off.

THIRD TEST—The invention was taped to a bucket full of lead. At 7 yards a Smith and Wesson 686 gun with a 4" barrel was fired using a 357-magnum black talon hollow point bullet. The bullet embedded in the ballistic protection material without penetrating through the material.

FOURTH TEST—The embodied body armor was tested with a Colt 1911 gun that fired a 45-caliber black talon hollow point bullet at 7 yards. The bullet embedded in the fabric without penetrating through the fabric.

While these embodiments have been described with emphasis on the preferred embodiments, it should be understood that within the scope of the appended claims, the embodiments might be practiced other than as specifically described herein. covering the femoral arteries, optionally the genital area, optimally the thigh, optionally the abdomen and optionally the hips. Pockets with pads for the iliac vessels and femoral artery area with one or more of these additional pockets are considered usable with this invention.

Figure 5:
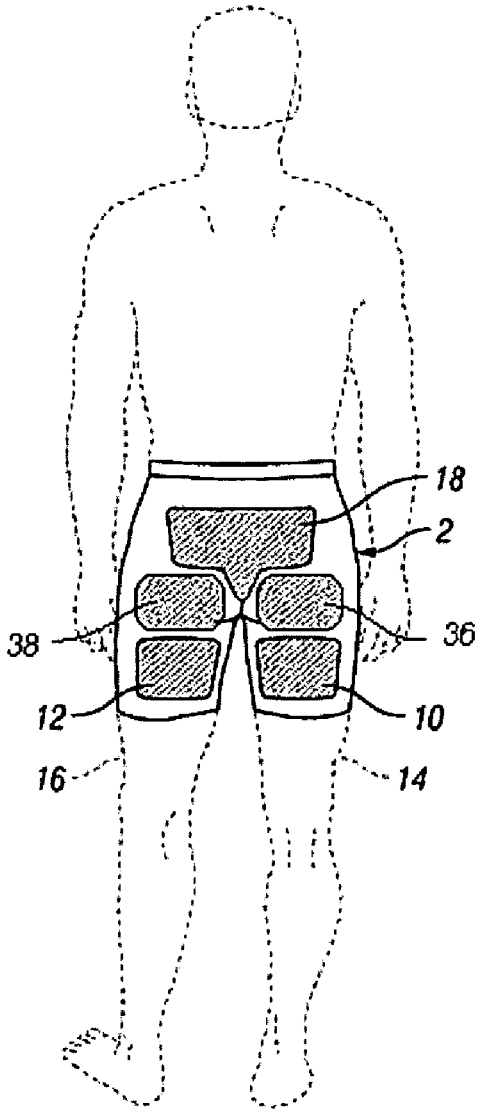
FIG. 5 depicts a rear perspective view of a pair of elastic tight fitting shorts with femoral artery protection, iliac vessel protection and tailbone protection in a T-configuration and additionally showing buttocks protection with multiple pockets.

FIG. 5 depicts two additional pockets on the pant 2 not shown in FIG. 3 or FIG. 4 covering the buttocks. The buttocks pockets, 36 and 38, can be located between the back pocket 18 and the back leg pockets 10 and 12.

Figure 6:
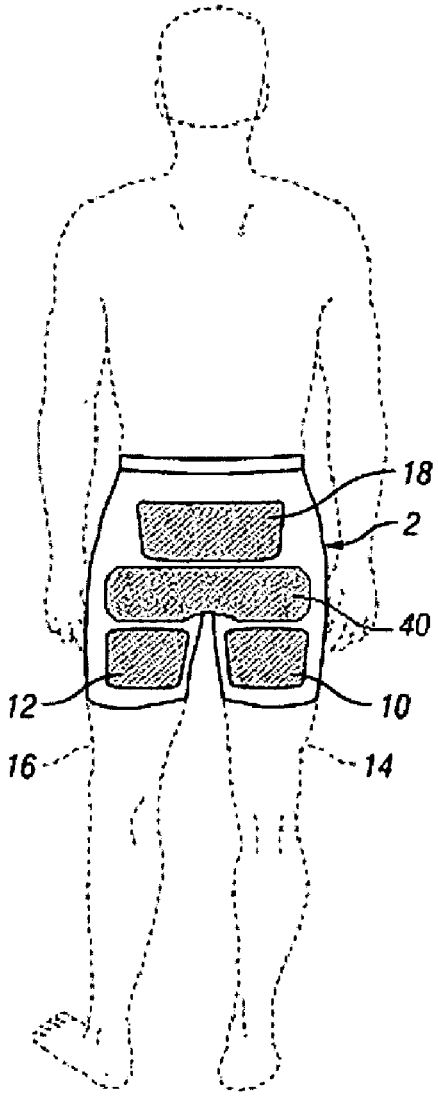
FIG. 6 depicts a rear perspective view of a pair of elastic tight fitting shorts with femoral artery protection, iliac vessel protection, and tailbone protection in a rectangular configuration and additionally showing buttocks protection with a single pocket.

FIG. 6 depicts another embodiment wherein only one pocket covers the buttocks. The buttock pocket 40, can be located between the back pocket 18 and the back leg pockets 10 and 12.

The ballistic protection packet for insertion in any of the above described pockets can have from one layer to 44 layers of ballistic material, preferably from eight layers to twenty-two layers of ballistic material.

The ballistic protection pads can be one of the classification National Institute of Justice Threat Levels consisting of National Institute of Justice Threat Level I, National Institute of Justice Threat Level IIa, National Institute of Justice Threat Level II, National Institute of Justice Threat Level IIIa, National Institute of Justice Threat Level III, and National Institute of Justice Threat Level IV.

The ballistic material can be a material such as "SPECTRAFLEX®" available from Allied Signal Company. It is noted that aramid fibers can be used, polyethylene fibers can be used, Twaron™ microfilaments, and Dyneema™ can be used as the ballistic fibers to make the ballistic packets.

The pockets can be closable with hook and loop fasteners such as those from Velcro, Inc of Manchester, N.H.

What is claimed is:

1. A one piece undergarment body armor for a wearer having an upper body and a lower body portion, further comprising:

a. a one piece undergarment with a neck opening further comprising a trunk portion integral with legs and sleeves;

b. at least two leg pockets fastened into the one piece undergarment body armor covering a femoral artery and an iliac vessels path for each leg;

c. at least one back pocket fastened into the one piece undergarment body armor covering the lower portion of the spine; and d. at least three removable ballistic protection pads with one pad configured to be inserted into each leg pocket and the back pocket.

2. The one piece undergarment body armor of claim 1, further comprising at least one chest pocket disposed over the sternum of the wearer, and wherein the chest pocket is adapted to house at least one ballistic protection pad.

3. The one piece undergarment body armor of claim 2, wherein the chest pocket is closeable.

4. The one piece undergarment body armor of claim 1, further comprising at least one upper body pocket covering at least a portion of one side of the upper body portion of a wearer, wherein upper body pocket houses at least one ballistic protection pad.

5. The one piece undergarment body armor of claim 4, wherein the upper body pocket is closeable.

6. The one piece undergarment body armor of claim 1, wherein the neck opening is partially closable with a fastener chosen from the group consisting of a hook and loop a fastener, a zipper, a snap, a button, a stitch, and combinations thereof.

7. The one piece undergarment body armor of claim 1, further comprising a hip pocket fastened into the undergarment pants over the sides of the hips of the wearer.

8. The one piece undergarment body armor of claim 7, wherein the hip pocket is closeable.

9. The one piece undergarment body armor of claim 8, wherein the hip pocket is closeable using a member of the group consisting of: a hook and loop a fastener, a zipper, a snap, a button, an adhesive, stitches, and combinations thereof.

10. The one piece undergarment body armor of claim 1, further comprising a front pocket fastened to cover the genital area of the body.

11. The one piece undergarment body armor of claim 10, wherein the front pocket is closeable.

12. The one piece undergarment body armor of claim 11, the front pocket is closeable using a member of the group consisting of: a hook and loop a fastener, a zipper, a snap, a button, an adhesive, stitches, and combinations thereof.

13. The one piece undergarment body armor of claim 1, further comprising at least one back leg pocket fastened into the undergarment pants covering at least the hamstring of a leg.

14. The undergarment body armor of claim 13, wherein the back leg pocket is closeable.

15. The one piece undergarment body armor of claim 14, wherein the back leg pocket closeable is using a member of the group consisting of: a hook and loop a fastener, a zipper, a snap, a button, an adhesive, stitches, and combinations thereof.

16. The one piece undergarment body armor of claim 1, further comprising at least one buttock pocket fastened into the undergarment pants covering at least a portion of the cheeks of the buttock.

17. The one piece undergarment body armor of claim 16, wherein the buttock pocket is closeable.

18. The one piece undergarment body armor of claim 17, wherein the buttock pocket is closeable using a member of the group consisting: of a hook and loop a fastener, a zipper, a snap, a button, an adhesive, stitches, and combinations thereof.

19. The one piece undergarment body armor of claim 1, wherein the ballistic protection pads are one of the classification National Institute of Justice Threat Levels of the National Institutes of Justice wherein the classification National Institute of Justice Threat Levels are members of the group consisting of National Institute of Justice Threat Level I, National Institute of Justice Threat Level IIa, National Institute of Justice Threat Level II, National Institute of Justice Threat Level IIIa, National Institute of Justice Threat Level III, and National Institute of Justice Threat Level IV.

20. The one piece undergarment body armor of claim 19, wherein the ballistic protection pads consist of a an aramid fiber, polyethylene fibers and combinations thereof.

21. The one piece undergarment body armor of claim 19, wherein the ballistic protection pads comprise from 1 layers to 44 layers of ballistic material.

22. The one piece undergarment body armor of claim 1, wherein the upper body pocket, the leg pockets, the front pocket, the back pocket, the back leg pockets, the buttock pockets, and the hip pocket are attached with a fastener chosen from the group consisting of a hook and loop a fastener, a zipper, a snap, a button, a stitch, and combinations thereof.

23. The one piece undergarment body armor of claim 1, further comprising a hard plate supported within at least one of the pockets in addition to the removable ballistic protection pads.

24. The one piece undergarment body armor of claim 23, wherein the hard plate comprises a metal plate encapsulated in a polyurethane or a ceramic tile encapsulated in a nylon material.

25. The one piece undergarment body armor of claim 1, wherein the back pocket is in a shape selected from the group consisting of a T-shape, a cross shape, and a shape with a height and a width where the height is longer than the width.

26. The one piece undergarment body armor of claim 25, wherein the back pocket is an ellipsoid shape.

27. The one piece undergarment body armor of claim 1, where the undergarment pant is made of an elastic material.

28. The one piece undergarment body armor of claim 27, where the elastic material is nylon and lycra or nylon and cotton and the elastic material is adapted to wick away moisture of the wearer for at least 8 hours.

29. The one piece undergarment body armor of claim 28, where the elastic material is made of 80% nylon and 20% lycra or 80% nylon and 20% cotton and the elastic material is adapted to wick away moisture of the wearer for at least 8 hours.

30. The one piece undergarment body armor of claim 1, where the undergarment pant conforms to the contours of the body.

* * * * *